US007302905B1

(12) United States Patent
Wynne

(10) Patent No.: US 7,302,905 B1
(45) Date of Patent: Dec. 4, 2007

(54) SHARK REPELLENT SYSTEM

(76) Inventor: Brian Wynne, 1 Meadowbrook Dr., Huntington, NY (US) 11746-2916

( * ) Notice: Subject to any disclaimer, the term of this patent is extended or adjusted under 35 U.S.C. 154(b) by 0 days.

(21) Appl. No.: 11/695,999

(22) Filed: Apr. 3, 2007

Related U.S. Application Data

(63) Continuation-in-part of application No. 11/372,406, filed on Mar. 8, 2006, now abandoned.

(51) Int. Cl.
*B63B 17/00* (2006.01)

(52) U.S. Cl. ..... 114/343; 441/74

(58) Field of Classification Search ..... 367/107, 367/139; 119/174, 220; 43/9.2; 441/74; 114/343

See application file for complete search history.

(56) References Cited

U.S. PATENT DOCUMENTS 4,932,007 A * 6/1990 Suomala ..... 367/139
5,349,774 A * 9/1994 Parra ..... 43/9.2
5,570,322 A * 10/1996 Miller ..... 367/107
2003/0051674 A1* 3/2003 Leblanc ..... 119/220

* cited by examiner

*Primary Examiner*—Ed Swinehart

(57) ABSTRACT

A shark repellent system for repelling sharks away from an individual while boating. The shark repellent system includes an attachable magnet and a transmitter unit that emits sound waves at a frequency undesirable to sharks. The transmitter unit is contained in a watertight enclosure affixed to a buoyant device, and is usually submerged in water while the buoyant device is in the water. The magnet may function as an on/off switch for the transmitter unit. The transmitter unit may also be positioned within the boat or other buoyant device, wherein the transmitter unit includes a plurality of transducers electrically connected to the transmitter unit via elongated cables and the cables and transmitter units are extended over the sides of the boat. The transmitter unit may also include a standard toggle switch and/or a water sensor to turn the transmitter unit and thus transducers on/off.

20 Claims, 14 Drawing Sheets

SHARK REPELLENT SYSTEM

CROSS REFERENCE TO RELATED APPLICATIONS

I hereby claim benefit under Title 35, United States Code, Section 120 of U.S. patent application Ser. No. 11/372,406 filed Mar. 8, 2006 now abandoned. This application is a continuation in-part of the Ser. No. 11/372,406 application. The Ser. No. 11/372,406 application is currently pending. The Ser. No. 11/372,406 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to animal repellent devices and more specifically it relates to a shark repellent system for repelling sharks away from an individual.

2. Description of the Related Art

Any discussion of the prior art throughout the specification should in no way be considered as an admission that such prior art is widely known or forms part of common general knowledge in the field.

Underwater acoustic beacons have been in use for years. Typically, underwater acoustic beacons continually send out a repetitive signal at a preset frequency. These devices are often times referred to as "pingers" which are often times utilized to mark locations or objects underwater for later recovery or relocation.

Current shark deterrent devices use an electric field for repelling a shark. The electric field is operated near a shark's nervous system's normal frequency which in turn, over stimulates the nervous system of the shark. Unfortunately, electric fields have a relatively limited range about the body of the user.

While these devices may be suitable for the particular purpose to which they address, they are not as suitable for repelling sharks away from an individual (surfer/diver) or watercraft. Conventional shark repellent systems have focused upon the usage of electric fields and chemical repellents, which have a limited range around a swimmer, surfer, diver and boater.

In these respects, the shark repellent system according to the present invention substantially departs from the conventional concepts and designs of the prior art, and in so doing provides an apparatus primarily developed for the purpose of repelling sharks away from an individual and watercraft.

BRIEF SUMMARY OF THE INVENTION

In view of the foregoing disadvantages inherent in the known types of animal repellent devices now present in the prior art, the present invention provides a new shark repellent system construction wherein the same can be utilized for repelling sharks away from an individual or watercraft.

The general purpose of the present invention, which will be described subsequently in greater detail, is to provide a new shark repellent system that has many of the advantages of the animal repellent devices mentioned heretofore and many novel features that result in a new shark repellent system which is not anticipated, rendered obvious, suggested, or even implied by any of the prior art animal repellent devices, either alone or in any combination thereof.

To attain this, the present invention generally comprises a transmitter unit positioned within an enclosure, a plurality of elongated cables extending from the transmitter unit and a plurality of transducers attached to opposing ends of the elongated cables as the transmitter unit, wherein the transducers are electrically connected to the transmitter unit via the elongated cables. The elongated cables and the transducers are waterproof. The transmitter unit is capable of producing sound waves, wherein the transducers receives the sound waves from the transmitter unit via the elongated cables and wherein the sound waves are emitted from the transducers within a volume of water in a pulsing manner at a frequency undesirable to sharks.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a shark repellent system that will overcome the shortcomings of the prior art devices.

A second object is to provide a shark repellent system for repelling sharks away from an individual while boating.

Another object is to provide a shark repellent system that is easily attached to a buoyant device.

An additional object is to provide a shark repellent system that is durable.

A further object is to provide a shark repellent system that emits sound waves at a frequency that is aggravating and deterring to sharks.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
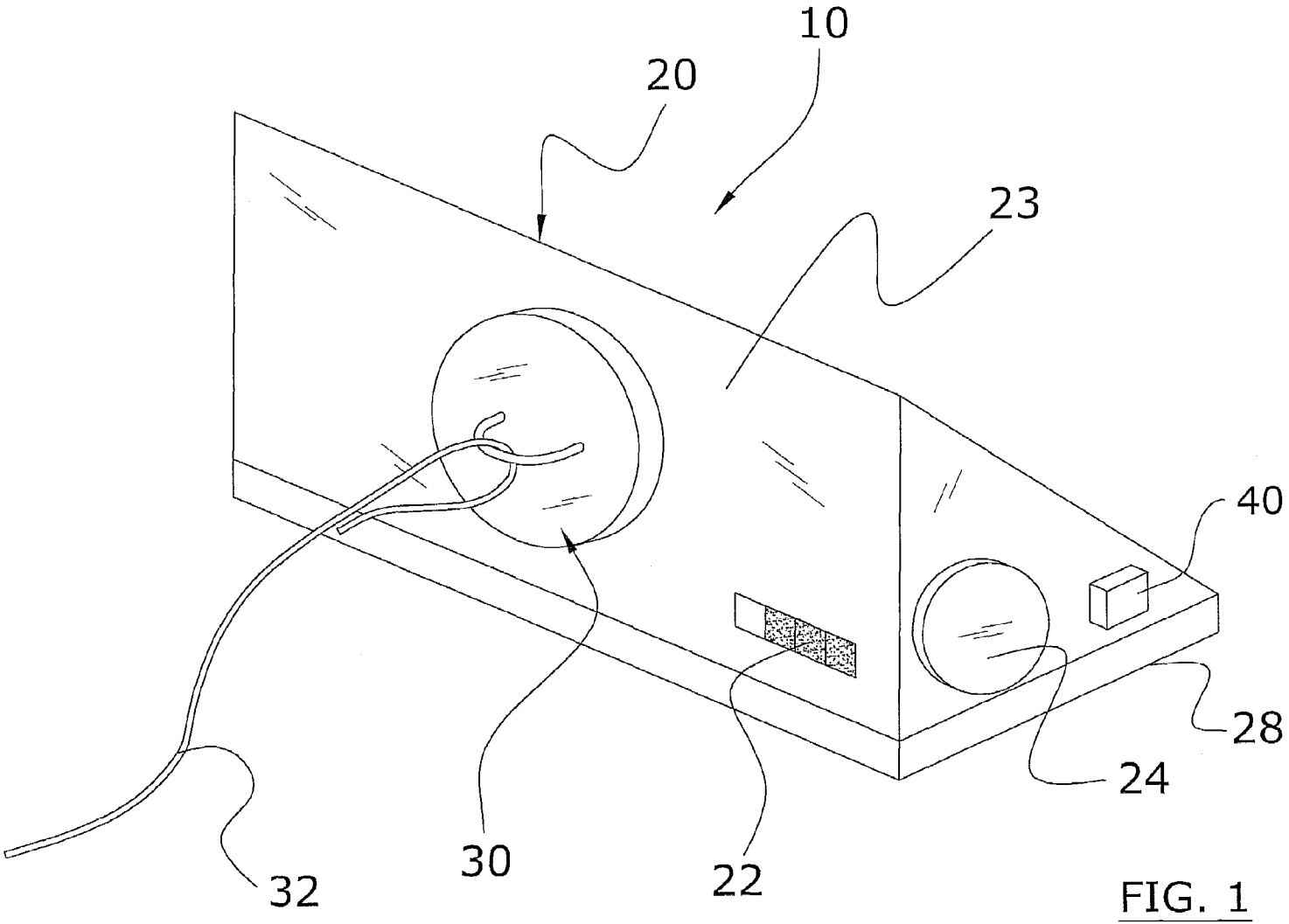
FIG. 1 is an upper perspective view of the present invention.

Turning now descriptively to the drawings, in which similar reference characters denote similar elements throughout the several views, FIGS. 1 through 14 illustrate a shark repellent system 10, which comprises an attachable magnet 30 and a transmitter unit 20 that emits sound waves 21 at a frequency undesirable to sharks 19. The transmitter unit 20 is contained in a watertight enclosure 23 affixed to a buoyant device. The magnet 30 attaches to the transmitter unit 20 functioning as an on/off switch for the transmitter unit 20 and is also preferably connected to the buoyant device by a tether 32. The applicant hereby incorporates by reference U.S. Pat. No. 6,606,963 and U.S. Pat. No. 7,037,153 into this application.

Figure 12:
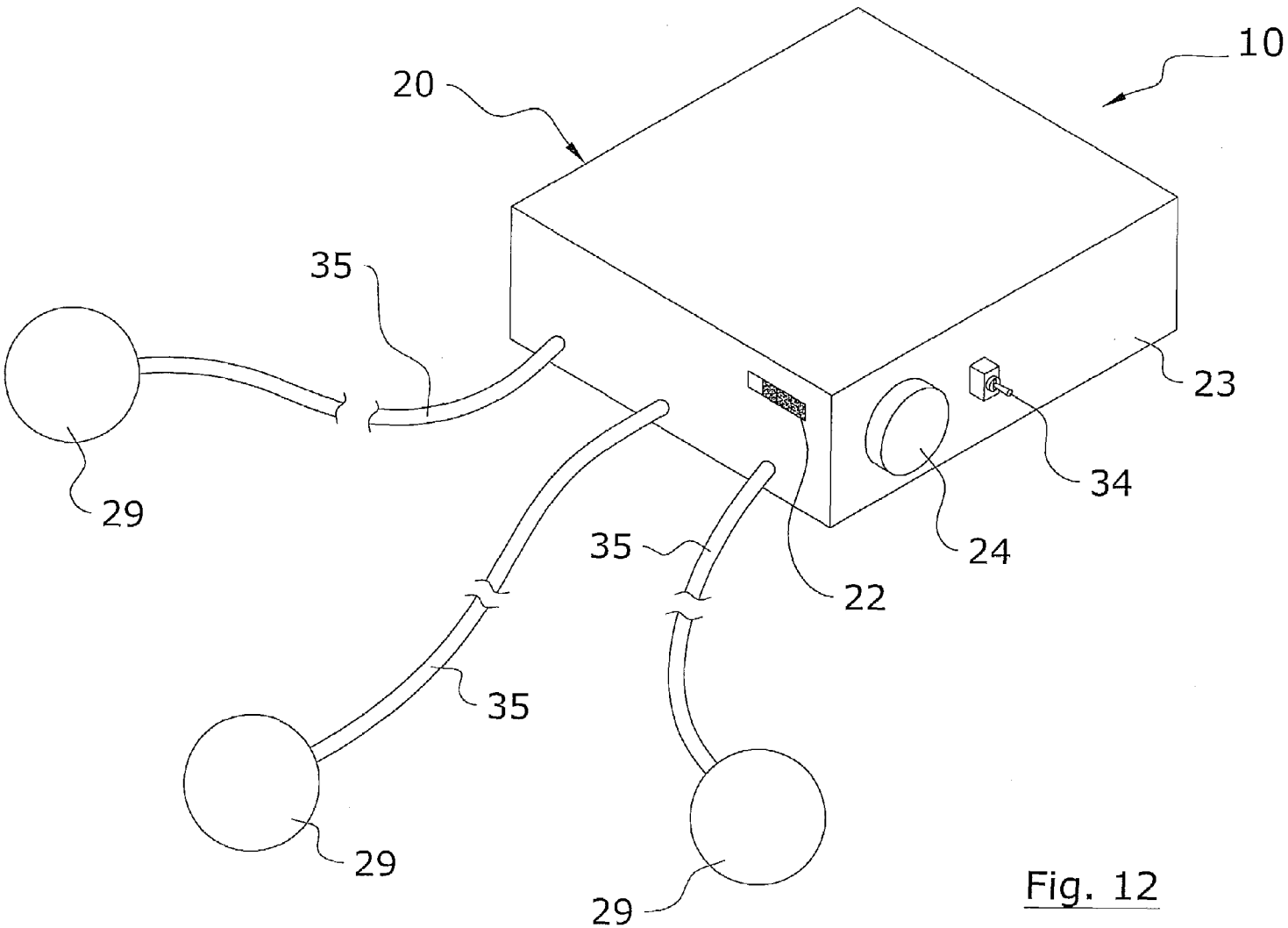
FIG. 12 is an upper perspective view of the present invention including a plurality of transducers.
Figure 13:
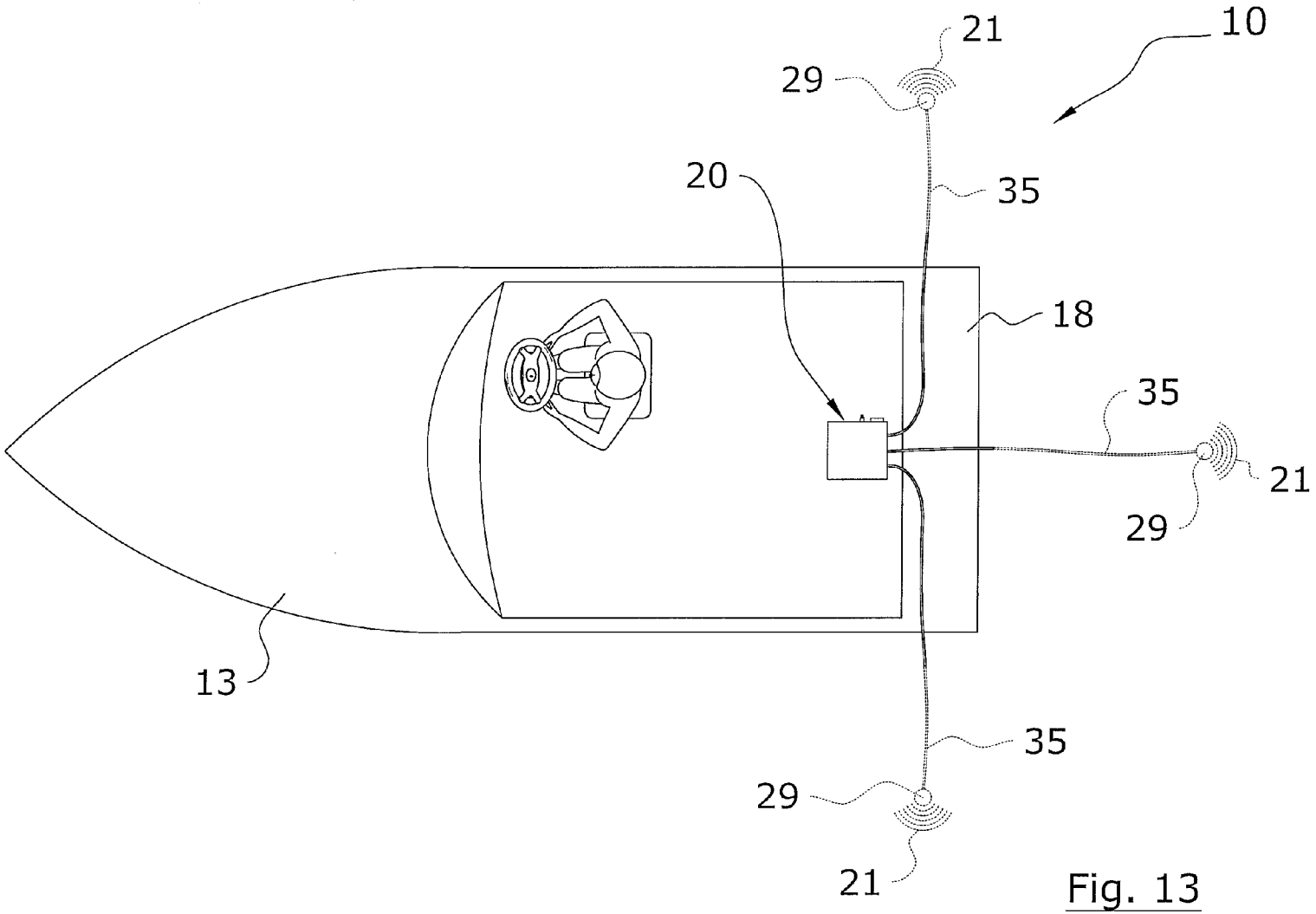
FIG. 13 is a top view of the present invention in use, wherein the present invention includes a plurality of transducers.
Figure 14:
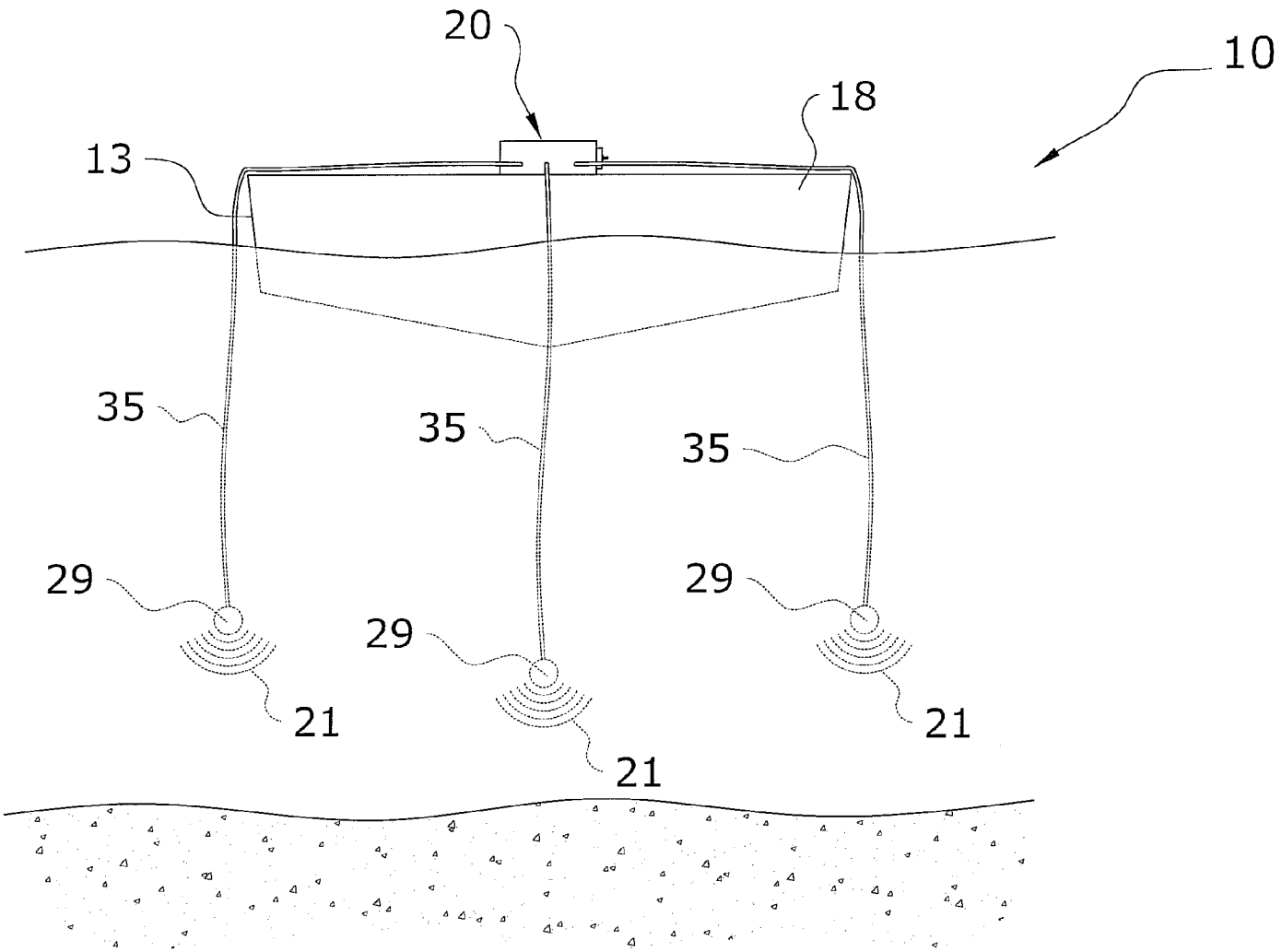
FIG. 14 is a rear view of the present invention in use, wherein the present invention includes a plurality of transducers.

The transmitter unit 20 may also be positioned within the boat 13 or other buoyant device, wherein the transmitter unit 20 preferably includes a plurality of transducers 29 electrically connected to the transmitter unit 20 via elongated cables 35 as illustrated in FIGS. 12 through 14. The transmitter unit 20 may also include a standard toggle switch 34 to turn the transmitter unit 20 and thus transducers 29 on/off.

B. Transmitter Unit

The transmitter unit 20 enclosure 23 is preferably comprised of a substantially rigid material which could withstand the weight of a user 12 stepping on it or being struck while loading and unloading into a vehicle. The transmitter unit 20 should be water tight with the enclosure 23 being impervious to liquids for preventing damage to the interior electronic components. The enclosure 23 is preferably made of a material that will withstand long exposure to salt water and humidity such that it will not rust or absorb water. The enclosure 23 is also preferably made of a material that will not degrade after long exposure to sunlight. The enclosure 23 is preferably molded plastic, however, is not limited from being metal or a composite material.

The transmitter unit 20 enclosure 23 is preferably constructed with a triangular cross section as illustrated in FIGS. 1, 2, 4, 5 and 8*a* through 10*b* of the drawings, but it can be appreciated that the enclosure 23 could be constructed in various other shapes such as but not limited to rectangular as illustrated in FIGS. 12 through 14. The transmitter unit 20 enclosure 23 may be triangular in shape to provide a more fluidly aerodynamic structure and to allow the user 12 to utilize the angled side as a traction pad assisting in the steering of a buoyant device, such as a surfboard 14. The transmitter unit 20 enclosure 23 is sized so the length dimension is preferably approximately 5 inches.

The transmitter unit 20 enclosure 23 is preferably comprised with an adhesive 28 backing on a mounting surface. The adhesive 28 will preferably withstand long exposure to salt water, humidity and sunlight such that the adhesive 28 will be resistant to delaminating. The adhesive 28 is preferably used for attaching the transmitter unit 20 to the buoyant device's rear end 18 as best illustrated in FIGS. 8*a* through 10*b* of the drawings. It can be appreciated by one skilled in the art that other methods of attachment (e.g. fasteners) could be used to attach the transmitter unit 20 to a buoyant device.

The transmitter unit 20 may also be positioned within the buoyant device as illustrated in FIGS. 12 through 14. In the case of positioning the transmitter unit 20 within the buoyant device, the transmitter unit 20 may be fixedly attached utilizing bolt or screws, may utilize the adhesive 28 to attach within the buoyant device or may simply be positioned freely within the buoyant device. The transmitter unit 20 may further by built into the buoyant device, wherein the cables 35 extend out from opposing sides and the rear end of the buoyant device.

As shown in FIGS. 4, 7, 8*b*, 9*b* and 10*b*, the transmitter unit 20 emits sound waves 21 in a directional or omni directional manner. It is preferable that the transmitter unit 20 emits the sound waves 21 in an omni directional manner so as to ensure that sharks 19 near the user 12 are thoroughly deterred regardless of their location with respect to the user 12. The sound waves 21 are preferably at a frequency that is unpleasant to a shark 19. The transmitter unit 20 should emit sound waves 21 within the frequency band between 200 to 1500 hertz, but preferably in the frequency band between 700 to 900 hertz that has been found highly undesirable to sharks 19.

Figure 3:
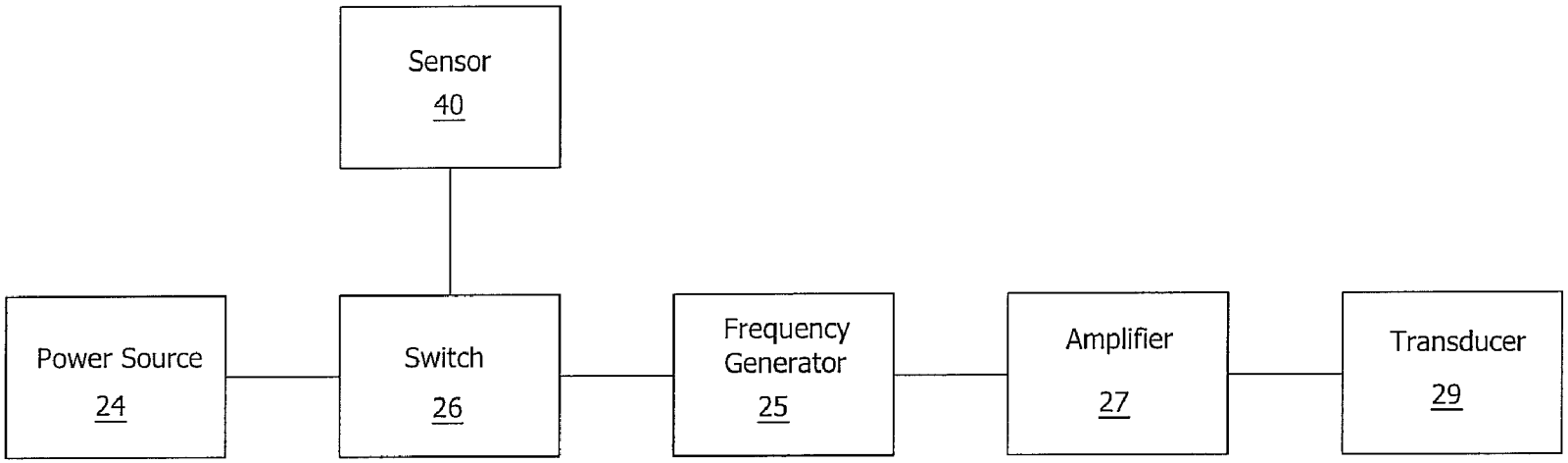
FIG. 3 is a block diagram of the electronic circuitry for the present invention.
Figure 4:
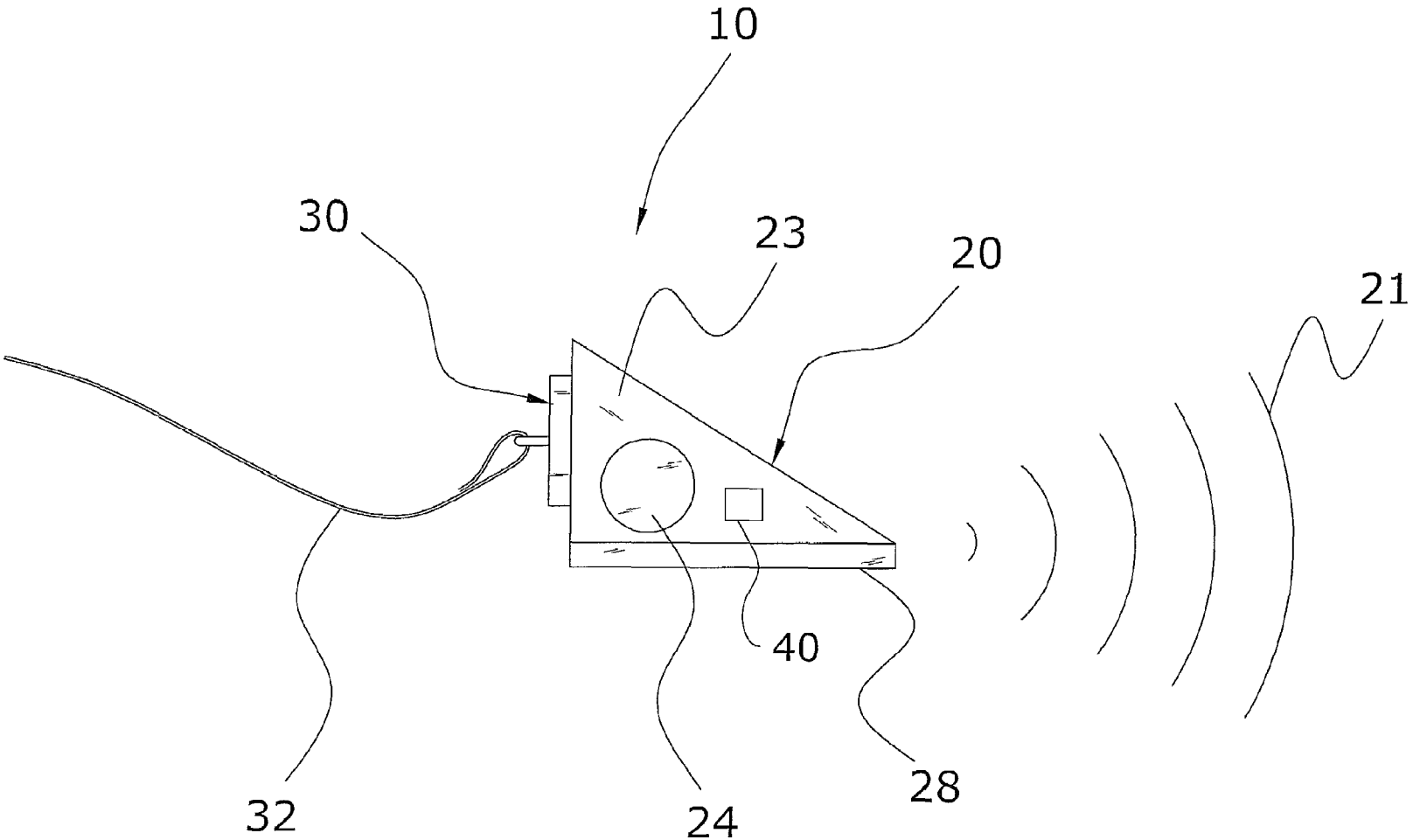
FIG. 4 is a side view of the present invention with the magnet attached showing the transmission of sound waves.
Figure 5:
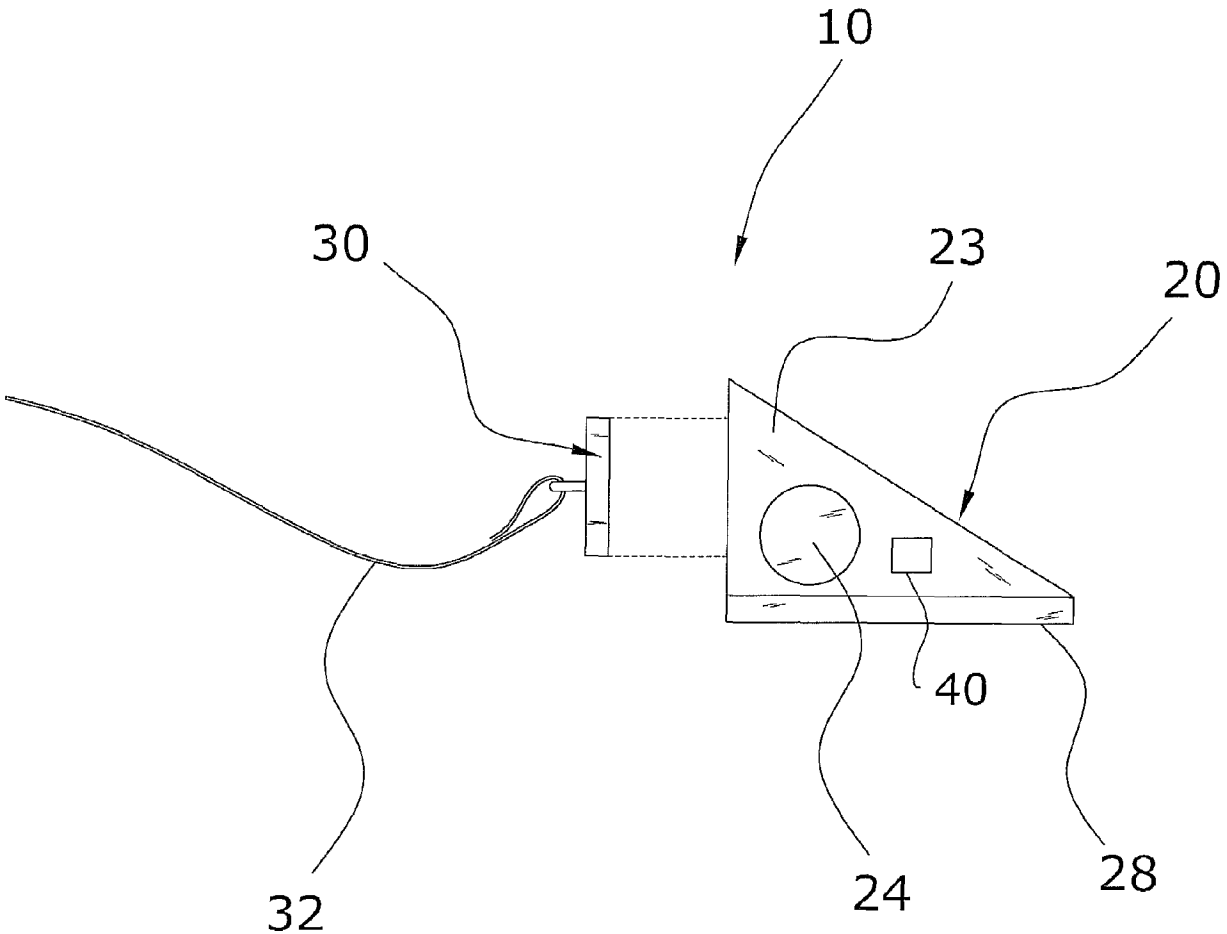
FIG. 5 is an exploded side view of the present invention where the magnet is unattached to the switch.
Figure 6:
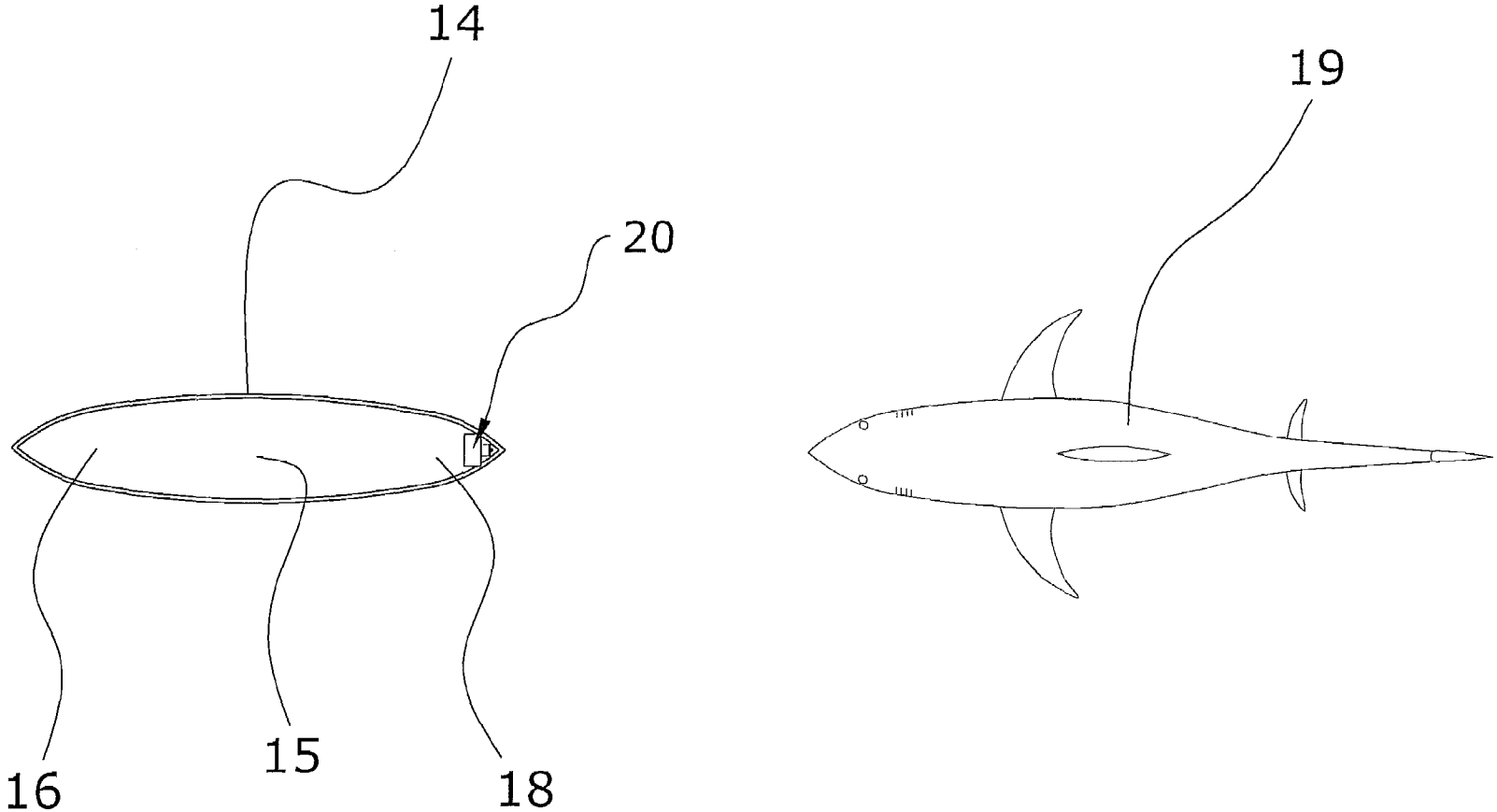
FIG. 6 is a top view of the present invention mounted on a surfboard and an approaching shark where the magnet is unattached to the switch.
Figure 7:
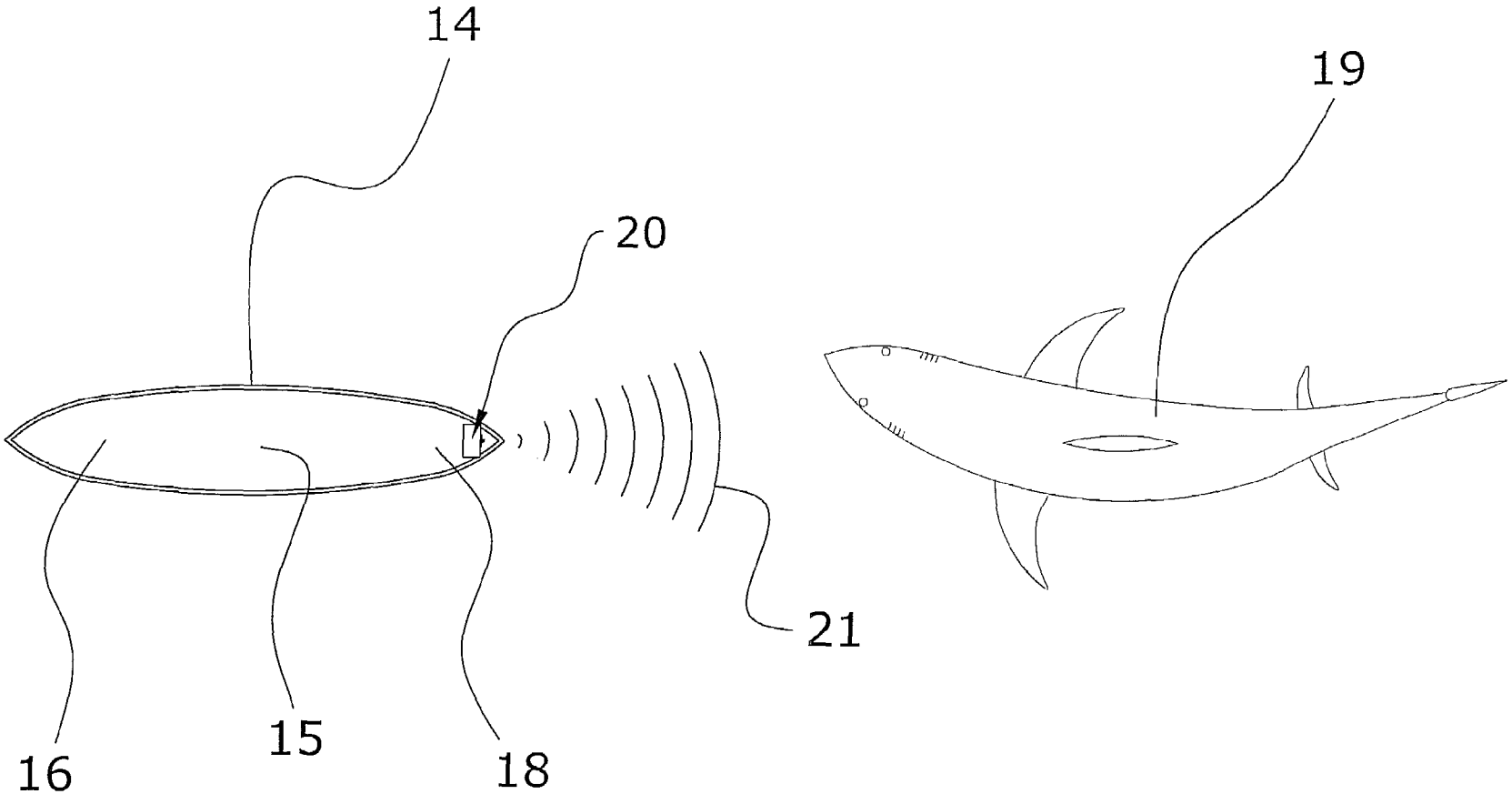
FIG. 7 is a top view of the present invention mounted and activated on a surfboard where the magnet is attached to the switch showing the transmission of sound waves and a deterred shark.

The transmitter unit 20 preferably includes the enclosure 23, a power source 24, a power indicator 22, a frequency generator 25, a switch 26, an amplifier 27 and a transducer 29 as illustrated in FIG. 3 of the drawings. The power source 24 may be comprised of any type of portable source such as a battery. A switch 26, preferably utilizing the Hall Effect method activated by the placement of the magnet 30 may be electrically connected between the power source 24 and the frequency generator 25 as an on/off control.

It can also be appreciated by those skilled in the art that other on/off controls can be used, including sensors 40 that detect when water is present or whether the transmitter unit 20 is submerged in water, whereby the switch 26 is activated when it receives a communication from the sensor(s) 40 that water is present or the transmission unit 20 is submerged in water. It is further appreciated that a toggle switch 34 may be utilized to turn the present invention on/off. The power indicator 22 is preferably located on an outside surface of the enclosure 23 and indicates the remaining power level of the power source 24.

The frequency generator 25 is electrically connected to the power source 24 and may be comprised of any type of generator circuitry commonly utilized to generate a single frequency that is non-adjustable. The frequency signals generated by the frequency generator 25 are preferably comprised of a pulsed manner to reduce power consumption and thereby extend the life of the power source 24. However, the frequency signals generated by the frequency generator 25 may be in a random or constant manner. It can be appreciated that the frequency generator 25 may be comprised of a frequency generating system that creates varying frequencies.

As best shown in FIG. 3, the transducer 29 is electrically connected to the amplifier 27 for emitting the sound waves 21 within the water. The transducer 29 is preferably positioned within the enclosure 23 of the transmitter unit 20 in such a manner as to encourage omni directional sound wave 21 generation with limited obstruction by the body of the user 12 or by a buoyant device. The transducer 29 may be comprised of any well-known structure utilized for generating sound waves 21 within water such as pinger devices.

The transmitter unit 20 may also include a plurality of transducers 29 electrically connected via elongated cables 35 as illustrated in FIGS. 12 through 14. The elongated cables 35 are comprised of insulated cables 35 capable of being positioned within water. The cables 35 are also preferably comprised of a substantial length (i.e. 25 feet, 50 feet, etc.) in order for the transducers 29 to be positioned deep within the water. The cables 35 also preferably include a substantially durable, strong and flexible outer coating so as to increase the longevity of the cables 35 and provide proper support for the transducers 29.

The plurality of transducers 29 are also preferably electrically connected in a parallel configuration via the cables 35 to the transmitter unit 20. It is also appreciated that both the transducers 29 and the cables 35 are waterproof. The cables 35 may be comprised of various configurations all of which would transmit a signal (i.e. sound waves, etc.) from the transmitter unit 20 through water to the transducers 29.

When utilizing the cables 35, the transducers 29 are preferably positioned upon opposing ends of the cables 35 as the transmitter unit 20. The transmitter unit 20 may include various numbers of transducers 29. In the preferred embodiment of the present invention, the transmitter unit 20 includes 3 transducers 29, wherein 2 of the transducers 29 are extended over opposing sides of the buoyant device within the water and 1 of the transducers 29 is positioned over a rear end 18 of the buoyant device within the water as illustrated in FIGS. 13 and 14. The use of the multiple transducers 29 attached to the cables 35 helps to cover a wider area around the buoyant device to prevent sharks 19 from traveling anywhere near the buoyant device.

C. Magnet and Attachment

Figure 2:
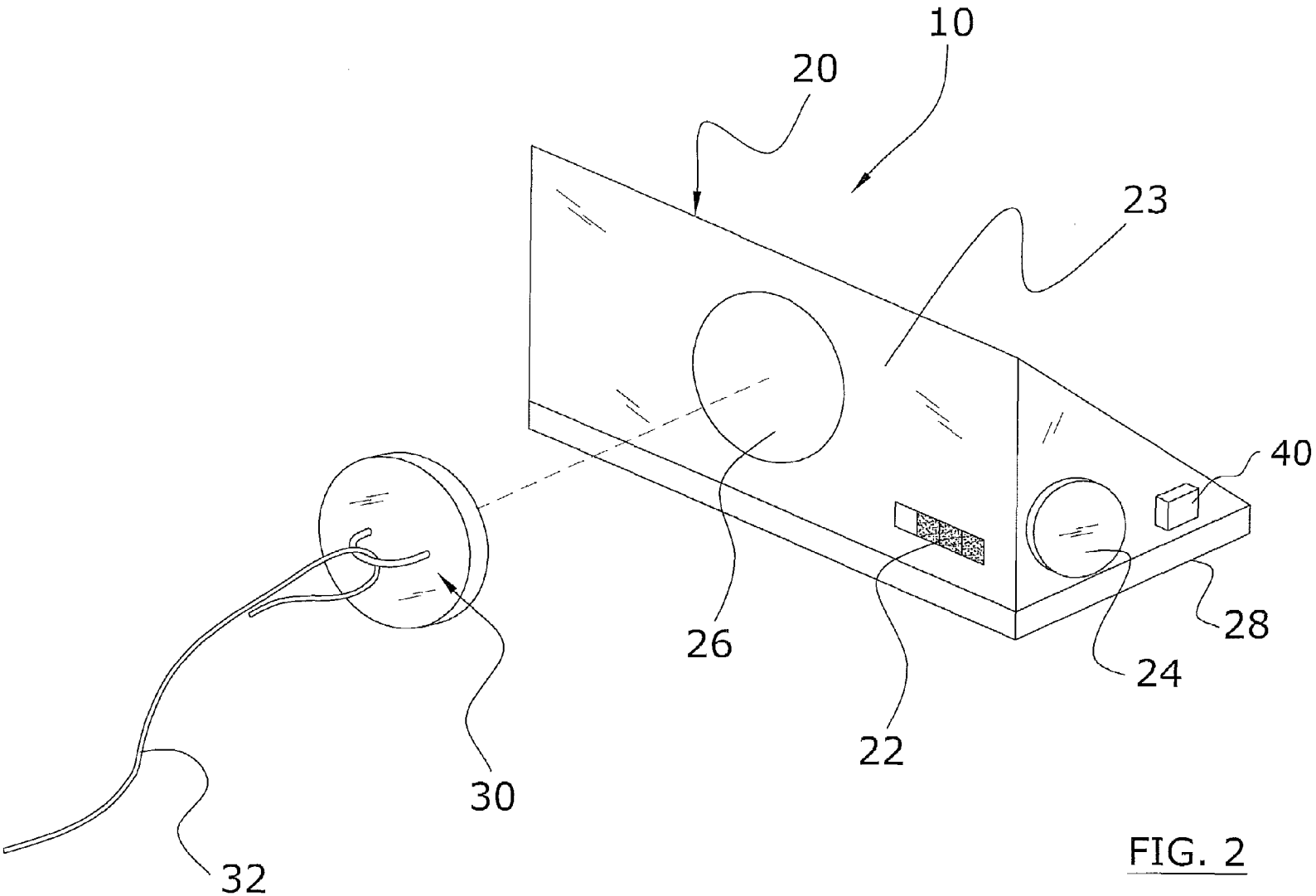
FIG. 2 is an exploded upper perspective view of the present invention.

The magnet 30 is preferably a round cylindrical structure as shown in FIGS. 1 and 2, but it can be appreciated that other shapes could be utilized. The magnet 30 may additionally be coated with a finishing material or process (e.g. powder coating), which must withstand long exposure to salt water, humidity and sunlight. The magnet's 30 magnetic force is preferably strong enough to remain attached to the transmitter unit 20 while engaging in water activities including but not limited to surfing or boating, but also must be detachable by hand when not required.

The magnet 30, when attached to the switch 26 located on the transmitter unit 20, activates the frequency generator 25 to create the desired sound waves 21 as shown in FIGS. 1, 4, 7, 8*b*, 9*b* and 10*b*. When the magnet 30 is detached from the switch 26 located on the transmitter unit 20 (e.g. when the buoyant device is being transported by a vehicle) the frequency generator 25 stops emitting sound waves 21 and conserves the power source 24 as best shown in FIGS. 2, 5, 6, 8*a*, 9*a* and 10*a*. It can be appreciated that a magnet 30 is not the only means of activating the frequency generator 25, as other means of activating the frequency generator 25 can be used (e.g. sensors 40 that detect whether water is present or whether the transmitter unit 20 is submerged in water).

The magnet 30 is preferably attached to a tether 32 that is strapped to the buoyant device as shown in FIGS. 8*a* through 10*b* (e.g. a clip 38 a surfboard 14, a cleat 37 a boat 13, or a clip 38 on the rear of the boat 13). The tether 32 is preferably constructed of an elastic or nylon material to obtain a secure fit when strapped to the buoyant device. It is appreciated that when positioning the transmitter unit 20 within the buoyant device, the transmitter unit 20 may simply include a toggle switch 34 to turn on/off the transmitter unit 20 and transducers 29.

D. Operation of the Invention

In use, the shark repellent system 10 is preferably attached to a boat 13, but it can be appreciated that the shark repellent system 10 could also be attached to or placed in other water buoyant devices (e.g. raft, buoy, jet ski, etc.). The magnet 30 is connected to the switch 26 of the transmitter unit 20 activating the frequency generator 25 within the transmitter unit 20.

Initially the transmitter unit 20 of the shark repellent system 10 is adhered to towards the rear lower portion of a boat 13 (or other buoyant device) using the adhesive 28 on the transmitter unit 20 as shown in FIGS. 6 through 10*b*. It may also be located at the rear lower end of a boat 13, as the rear lower end of a boat 13 is usually submerged in the water more often than any other portion of the boat 13 as shown in FIGS. 9*a* through 10*b*. It can be appreciated that if used on other buoyant devices, the shark repellent system 10 could be placed on a lower surface 17 to deter any sharks 19 in the area, so long as placing the shark repellent system 10 on the lower surface 17 allows the transmitter unit 20 to be submerged in water while the buoyant device is in use as shown in FIGS. 8*a* through 10*b*.

Figure 8A:
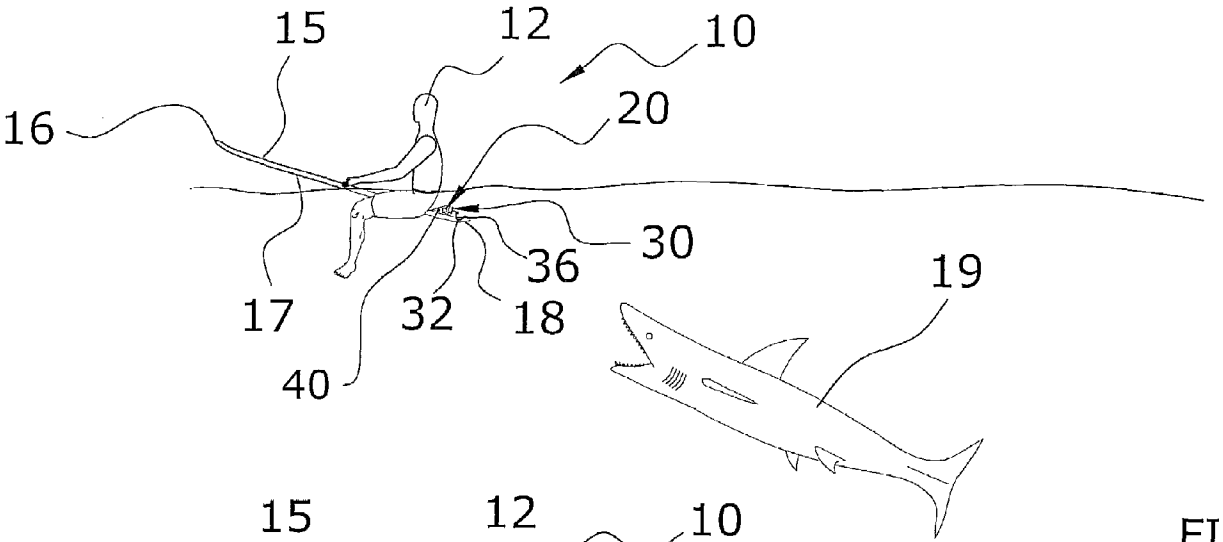
FIG. 8*a* is a side view of the present invention mounted on a surfboard and connected to the surfboard by a tether as a shark approaches where the magnet is unattached to the switch.
Figure 8B:
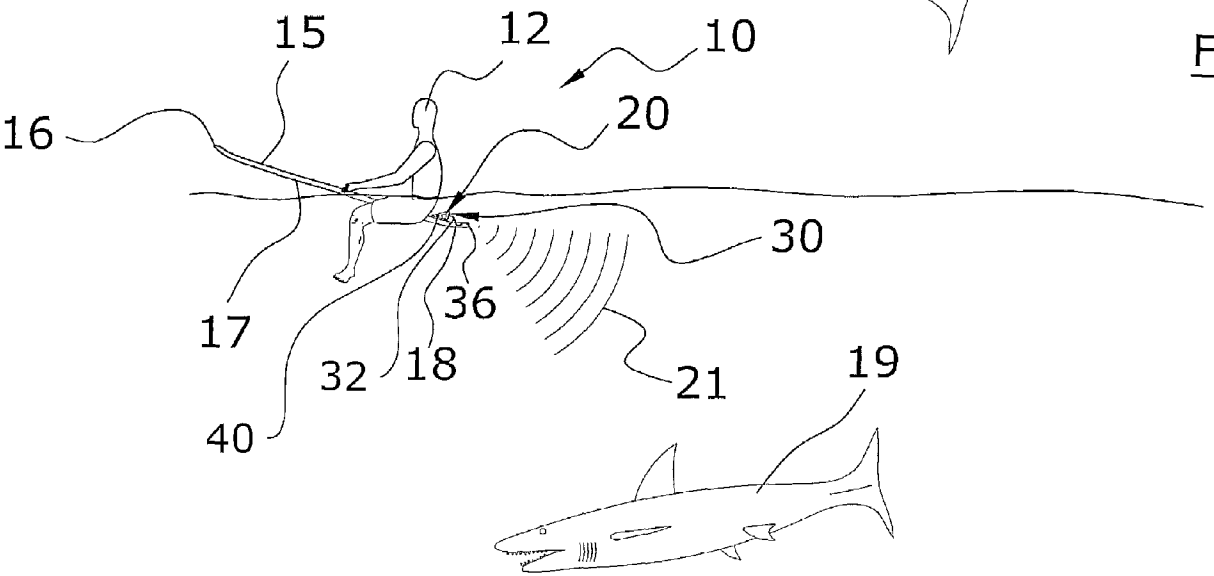
FIG. 8*b* is a side view of the present invention mounted and activated on a surfboard where the magnet is attached to the switch showing the transmission of sound waves and a deterred shark.
Figure 9A:
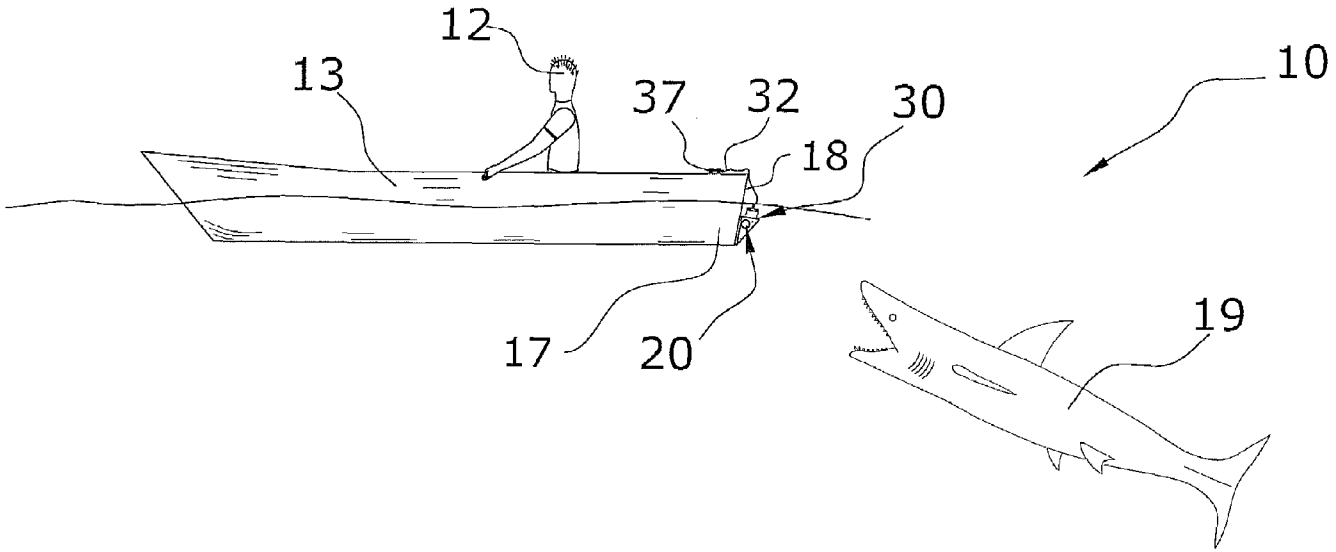
FIG. 9*a* is a side view of the present invention mounted on a boat and connected to a cleat on the boat by a tether as a shark approaches where the magnet is unattached to the switch.
Figure 9B:
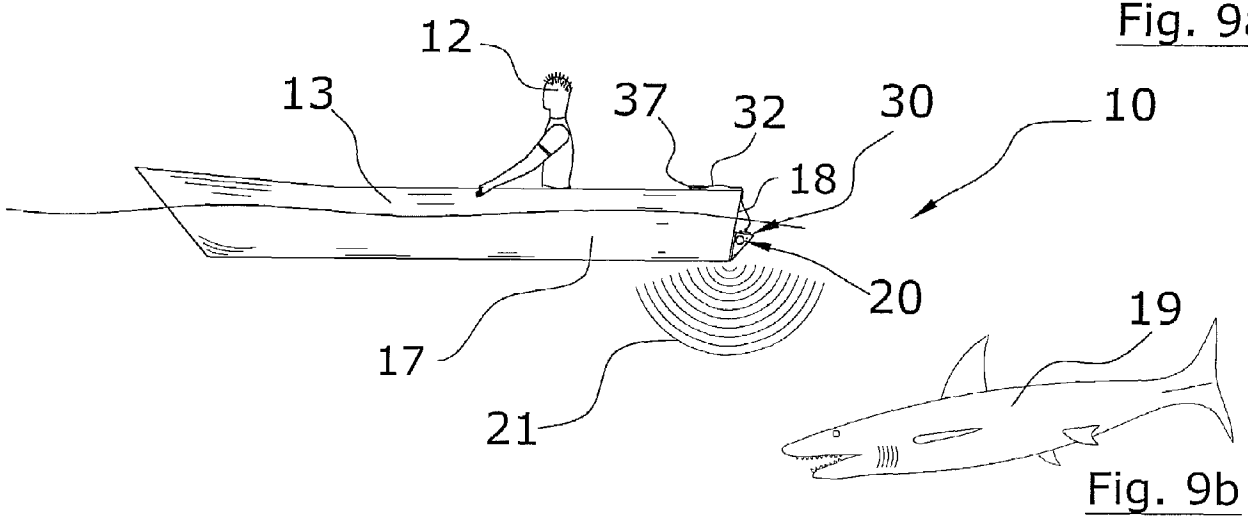
FIG. 9*b* is a side view of the present invention mounted and activated on a boat where the magnet is attached to the switch showing the transmission of sound waves and a deterred shark.
Figure 10A:
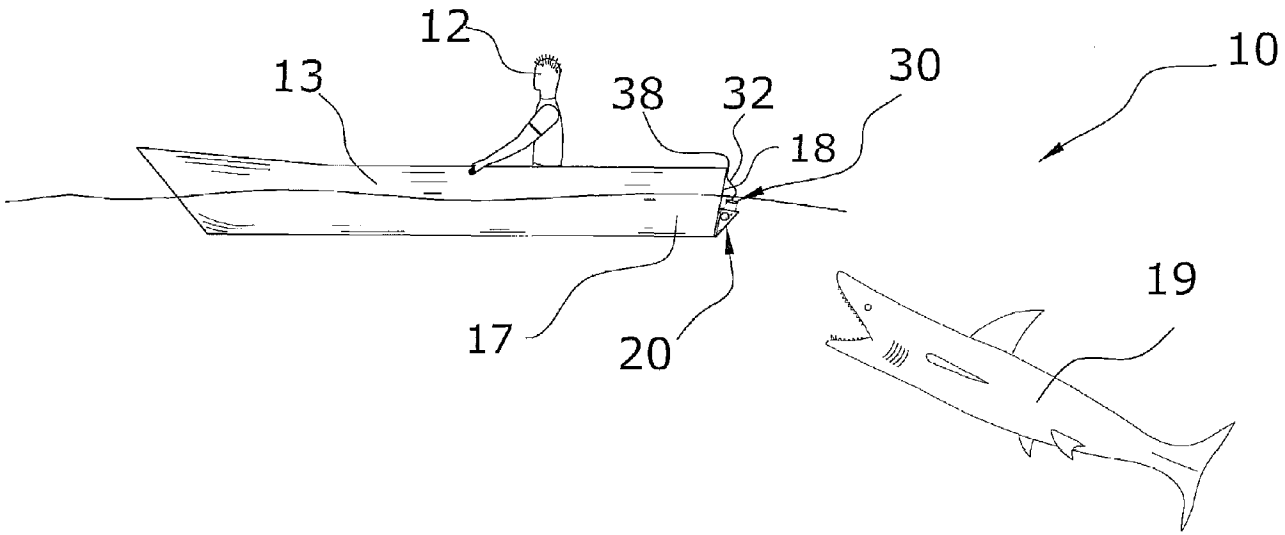
FIG. 10*a* is a side view of the present invention mounted on a boat and connected to a clip on the boat by a tether as a shark approaches where the magnet is unattached to the switch.
Figure 10B:
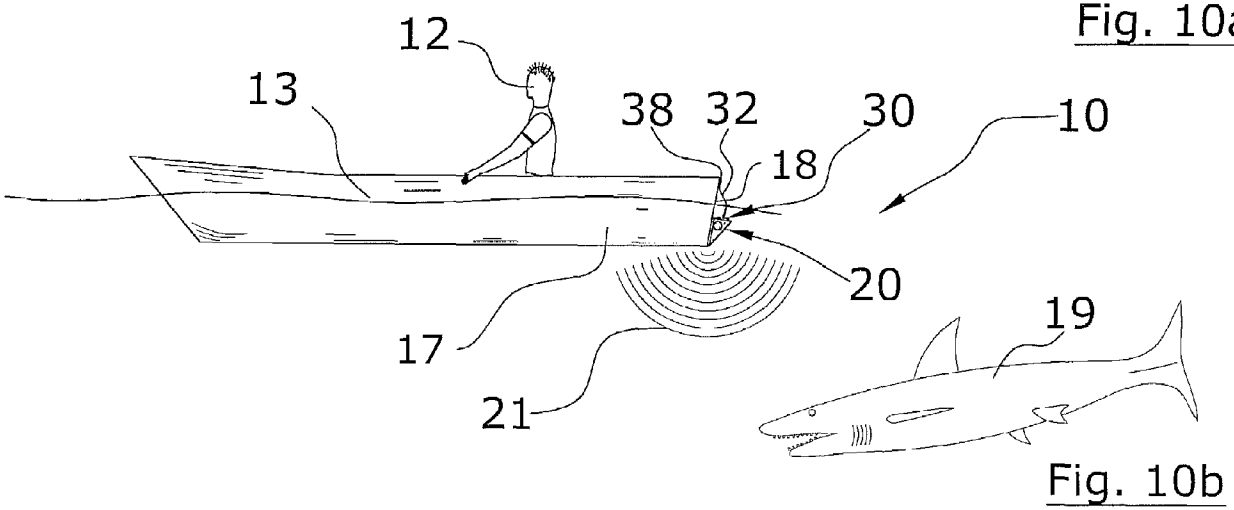
FIG. 10*b* is a side view of the present invention mounted and activated on a boat where the magnet is attached to the switch showing the transmission of sound waves and deterred shark.
Figure 11:
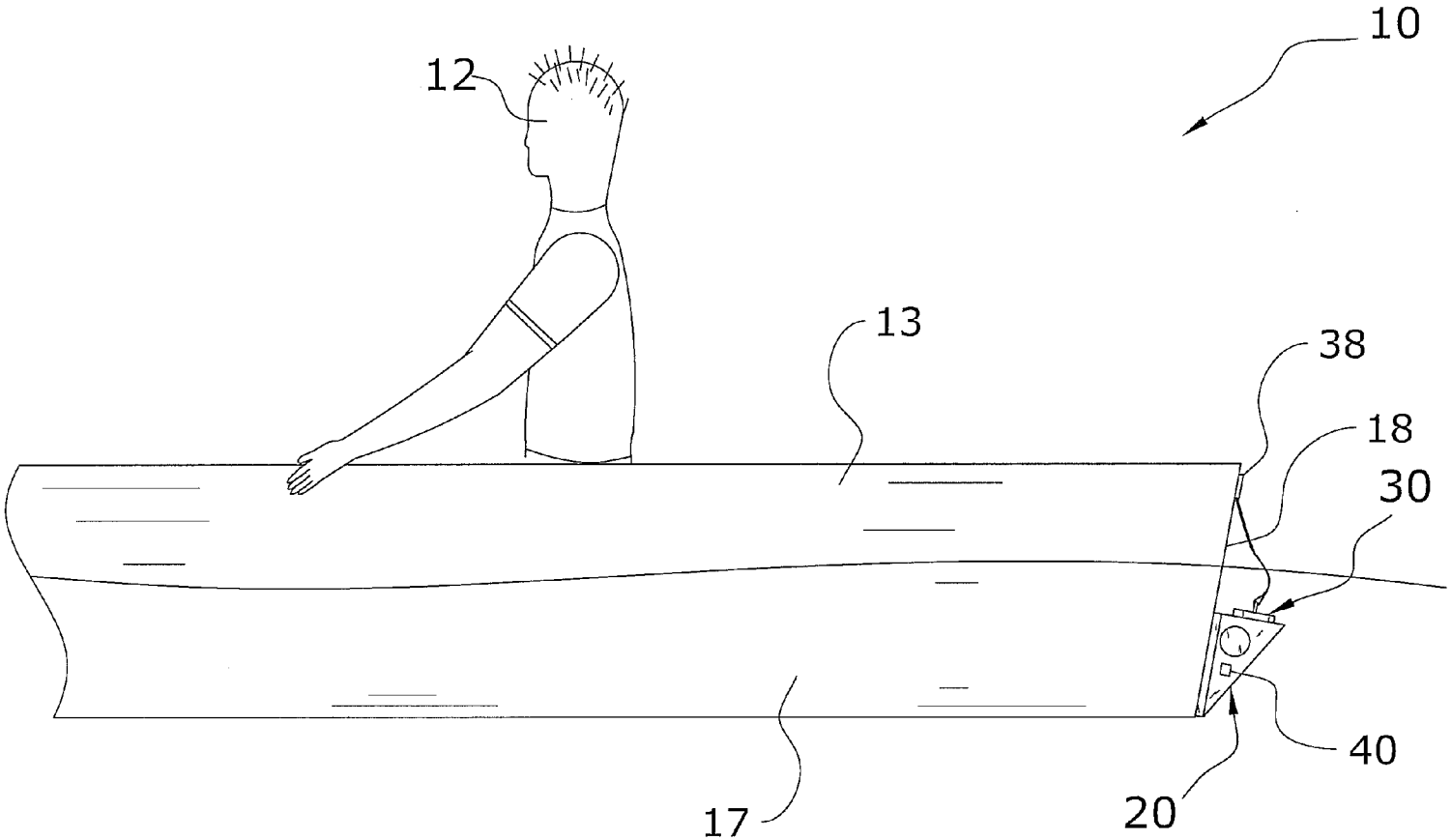
FIG. 11 is a magnified side view of the present invention mounted on a boat with a water sensor attached to repellent device.

In use, as shown in FIGS. 8*b*, 9*b* and 10*b*, the user 12 ties off the tether 32 to the surfboard 36, the cleat 37 or clip 38 on the boat 13. The opposing end of the tether 32 is attached to the magnet 30, which engages or disengages the transmitter unit 20 via the switch 26. With the magnet 30 attached to the transmitter unit 20 switch 26, the frequency generator 25 begins emitting sound waves 21 and the user 12 can more safely wait in the water. Once moving on the buoyant device, the user 12 can either keep the magnet 30 attached to the transmitter unit 20 switch 26 as shown in FIGS. 1, 4, 7, 8*b*, 9*b* and 10*b* or detach the magnet from the transmitter unit 20 switch 26 to conserve the power source 24 as shown in FIGS. 2, 5, 6, 8*a*, 9*a* and 10*a*. If the switch 26 is regulated by a on/off control other than a magnet 30 (e.g. a sensor 40), the on/off control and thereby the switch 26 can be similarly deactivated to conserve the power source 24 while boating as shown in FIGS. 2, 5, 8*a*, 9*a*, and 10*a*.

In the alternate configuration of the present invention, the transmitter unit 20 is first positioned within the buoyant device (i.e. boat 13, kayak, jet ski, etc.), wherein the transmitter unit 20 is preferably positioned in a center of the boat 13 and preferably near the rear end 18. The transmitter unit 20 may also be affixed to the boat 13 utilizing various methods, such as but not limited to adhesive 28, bolts or VELCRO. The transmitter unit 20 is further preferably positioned in an area of the boat 13 that is not substantially in the way of traffic within the boat 13 (i.e. individuals walking around, etc.).

Once the boat 13 is in the water and the water is at a substantial depth (i.e. deeper than the length of the cables 35) the transducers 29 and cables 35 may be extended over the sides and rear end 18 of the boat 13. The transducers 29 are preferably let down in the water by slowly letting out more and more cable 35 until the cables 35 are fully extended out of the boat 13 as illustrated in FIGS. 12 and 13. It is appreciated that if the present invention is to be utilized, and the depth of the water is less than the length of the cables 35, the cables 35 may be shortened by affixing a portion of the cables 35 within the boat 13 or other buoyant device.

The transmitter unit 20 and thus transducers 29 may now be turned ON, by positioning the toggle switch 34 in the ON position. The present invention is now ready to be utilized. When finished utilizing the present invention (i.e. going to shore, docking the boat 13, etc.), the cables 35 and attached transducers 29 are pulled out of the water and positioned within the boat 13. To reutilize the present invention the above process is simply repeated.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A shark repellent system, comprising:

an enclosure positioned within a buoyant device;

a transmitter unit positioned within said enclosure, wherein said transmitter unit is capable of producing sound waves;

a switch electrically connected to said transmitter unit;

a magnet removably attachable to said switch for controlling activation of said switch;

a plurality of elongated cables extending from said transmitter unit, wherein said plurality of elongated cables are comprised of a waterproof configuration; and a plurality of transducers attached to opposing ends of said plurality of elongated cables as said transmitter unit, wherein said plurality of transducers are electrically connected to said transmitter unit via said plurality of elongated cables and wherein said plurality of transducers receives said sound waves from said transmitter unit via said plurality of elongated cables;

wherein said sound waves are emitted from said plurality of transducers within a volume of water in a pulsing manner at a frequency undesirable to sharks;

wherein said plurality of transducers are comprised of a waterproof configuration.

2. The shark repellent system of claim 1, wherein said plurality of elongated cables are comprised of a length of at least 25 feet.

3. The shark repellent system of claim 1, wherein said plurality of elongated cables are comprised of a flexible configuration.

4. The shark repellent system of claim 1, wherein said plurality of transducers are electrically connected in parallel to said transmitter unit.

5. The shark repellent system of claim 1, wherein said transmitter unit includes:

a power source;

wherein said switch electrically connected to said power source;

a frequency generator electrically connected to said switch; and an amplifier electrically connected to said frequency generator.

6. The shark repellent system of claim 5, wherein said power source is comprised of a battery.

7. The shark repellent system of claim 5, wherein said switch is comprised of a toggle switch, wherein said toggle switch turns said transmitter unit on/off.

8. The shark repellent system of claim 5, wherein said frequency generator adjusts between a range of frequencies, wherein said range of frequencies is between 200 Hz and 1,500 Hz.

9. The shark repellent system of claim 5, wherein said frequency generator adjusts between a range of frequencies, wherein said range of frequencies is between 700 Hz and 900 Hz.

10. The shark repellent system of claim 1, wherein said enclosure is impermeable to water.

11. The shark repellent system of claim 1, wherein said enclosure is positioned near a rear end of said buoyant device.

12. The shark repellent system of claim 1, wherein said enclosure is attached to an upper surface of said buoyant device.

13. The shark repellent system of claim 1, wherein said buoyant device is comprised of a boat.

14. The shark repellent system of claim 1, wherein said plurality of transducers emit said sound waves in an omni directional manner.

15. The shark repellent system of claim 1, wherein said plurality of elongated cables consist of a first elongated cable, a second elongated cable and a third elongated cable.

16. The shark repellent system of claim 15, wherein said plurality of transducers consist of a first transducer, a second transducer and a third transducer.

17. A shark repellent system, comprising:

an enclosure positioned within a buoyant device;

a transmitter unit positioned within said enclosure, wherein said transmitter unit is capable of producing sound waves;

wherein said transmitter unit includes a power source, a switch electrically connected to said power source, a frequency generator electrically connected to said switch and an amplifier electrically connected to said frequency generator;

a magnet removably attachable to said switch for controlling activation of said switch;

a plurality of elongated cables extending from said transmitter unit, wherein said plurality of elongated cables are comprised of a waterproof configuration;

wherein said plurality of elongated cables are comprised of a flexible configuration; and a plurality of transducers attached to opposing ends of said plurality of elongated cables as said transmitter unit, wherein said plurality of transducers are electrically connected to said transmitter unit via said plurality of elongated cables and wherein said plurality of transducers receives said sound waves from said transmitter unit via said plurality of elongated cables;

wherein said sound waves are emitted from said plurality of transducers within a volume of water in a pulsing manner at a frequency undesirable to sharks;

wherein said plurality of transducers are electrically connected in parallel to said transmitter unit and wherein said plurality of transducers are comprised of a waterproof configuration.

18. The shark repellent system of claim 17, wherein said plurality of elongated cables are comprised of a length of at least 25 feet.

19. The shark repellent system of claim 17, wherein said switch is comprised of a toggle switch, wherein said toggle switch turns said transmitter unit on/off.

20. A shark repellent system, comprising:

an enclosure positioned within a buoyant device;

a transmitter unit positioned within said enclosure, wherein said transmitter unit is capable of producing sound waves;

a first elongated cable electrically connected to said transmitter unit;

a second elongated cable electrically connected to said transmitter unit;

a third elongated cable electrically connected to said transmitter unit;

wherein said first elongated cable, said second elongated cable and said third elongated cable are comprised of a waterproof configuration;

wherein said first elongated cable, said second elongated cable and said third elongated cable are each comprised of a length of at least 25 feet;

wherein said first elongated cable, said second elongated cable and said third elongated cable are comprised of a flexible configuration;

a first transducer electrically connected to said first elongated cable opposite said transmitter unit;

a second transducer electrically connected to said second elongated cable opposite said transmitter unit; and a third transducer electrically connected to said third elongated cable opposite said transmitter unit;

wherein said first transducer, said second transducer and said third transducer are comprised of a waterproof configuration;

wherein said first transducer, said second transducer and said third transducer receive said sound waves from said transmitter unit via said first elongated cable, said second elongated cable and said third elongated cable;

wherein said first transducer, said second transducer and said third transducer are electrically connected in parallel to said transmitter unit;

wherein said sound waves are emitted from said first transducer, said second transducer and said third transducer within a volume of water in a pulsing manner at a frequency undesirable to sharks;

wherein said transmitter unit includes a power source, a switch electrically connected to said power source, a frequency generator electrically connected to said switch and an amplifier electrically connected to said frequency generator;

wherein said power source is comprised of a battery;

a magnet removably attachable to said switch for controlling activation of said switch;

wherein said frequency generator adjusts between a range of frequencies and wherein said range of frequencies is between 200 Hz and 1,500 Hz;

wherein said enclosure is impermeable to water;

wherein said first transducer, said second transducer and said third transducer emit said sound waves in an omni-directional manner.

* * * * *